US009084477B2

(12) United States Patent
Westbrook et al.

(10) Patent No.: US 9,084,477 B2
(45) Date of Patent: Jul. 21, 2015

(54) TABLE WITH A FAN

(71) Applicant: SHOP VAC CORPORATION, Williamsport, PA (US)

(72) Inventors: Kurt Westbrook, Cogan Station, PA (US); Seth A. Bartley, Williamsport, PA (US)

(73) Assignee: SHOP VAC CORPORATION, Williamsport, PA (US)

( * ) Notice: Subject to any disclaimer, the term of this patent is extended or adjusted under 35 U.S.C. 154(b) by 0 days.

(21) Appl. No.: 14/049,853

(22) Filed: Oct. 9, 2013

(65) Prior Publication Data

US 2014/0096707 A1 Apr. 10, 2014

Related U.S. Application Data

(60) Provisional application No. 61/711,498, filed on Oct. 9, 2012.

(51) Int. Cl.

| | |
|---|---|
| ***A47B 37/00*** | (2006.01) |
| ***A47B 13/00*** | (2006.01) |
| ***A47B 37/04*** | (2006.01) |

(52) U.S. Cl.

CPC ..... *A47B 13/00* (2013.01); *A47B 37/04* (2013.01); *A47B 2200/06* (2013.01)

(58) Field of Classification Search

CPC .... A47B 31/02; A47B 2200/06; A47B 27/04; A47B 37/00

USPC ..... 108/50.13, 25, 26

See application file for complete search history.

(56) References Cited

U.S. PATENT DOCUMENTS

| | | | | |
|---|---|---|---|---|
| 2,642,220 | A * | 6/1953 | Koch | 415/121.3 |
| 4,248,162 | A * | 2/1981 | Skeist | 108/50.13 |
| 4,623,367 | A * | 11/1986 | Paulson | 55/385.8 |
| 4,899,027 | A * | 2/1990 | Wong | 219/623 |
| 6,298,866 | B1 * | 10/2001 | Molnar, IV | 135/16 |
| 7,537,015 | B1 * | 5/2009 | Molnar, IV et al. | 135/16 |
| 8,166,893 | B2 * | 5/2012 | Davis | 108/90 |
| 2004/0221882 | A1 * | 11/2004 | Watson et al. | 135/16 |
| 2010/0154779 | A1 * | 6/2010 | Andors et al. | 126/512 |
| 2011/0146542 | A1 * | 6/2011 | Branning | 108/50.13 |
| 2012/0186499 | A1 * | 7/2012 | Chen | 108/50.13 |
| 2012/0318179 | A1 * | 12/2012 | Noeth | 108/50.13 |
| 2013/0021621 | A1 | 1/2013 | Sato | |
| 2013/0160679 | A1 * | 6/2013 | Federici et al. | 108/26 |
| 2013/0216213 | A1 * | 8/2013 | Thomas | 392/465 |
| 2014/0060396 | A1 * | 3/2014 | Landvik et al. | 108/50.13 |

OTHER PUBLICATIONS

Australian Office Action for Patent Application No. 2013202060, issued Sep. 12, 2014.

* cited by examiner

*Primary Examiner* — Robin Rohrhoff

(74) *Attorney, Agent, or Firm* — Marshall, Gerstein & Borun LLP

(57) ABSTRACT

A table includes a table top, a support pedestal having a plenum, the support pedestal arranged to support the table top, and a fan arranged to blow air upwardly toward the table top through the plenum. An air deflector may be arranged to deflect the air radially outwardly under the table top in a 360° pattern. A heating element, cooling element, and/or a volatile active delivery system may be included to heat and/or cool the air and/or deliver a volatile active into the air. An ice bucket may be removably received within a bucket holder arranged in a recess in or through the table top.

19 Claims, 3 Drawing Sheets

TABLE WITH A FAN

FIELD OF THE DISCLOSURE

The present disclosure relates generally to a table with a fan integrated therewith.

BACKGROUND

People frequently enjoy sitting around a table located in the outdoors or in an area that is generally open to the outdoors, such as a patio, porch, or balcony, to relax with family and friends while dining, playing a game, or enjoying conversation. However, in most parts of the world, the ambient temperature is often too hot or too cold to be entirely comfortable.

SUMMARY

In some aspects according to the teachings of the present disclosure, a table includes a table top and a support pedestal extending downwardly from a bottom side of the table top. The support pedestal is arranged to support the table top aligned generally horizontally and spaced above the floor or ground. A fan is arranged to blow air upwardly toward the table top through a plenum of the support pedestal. An air deflector is arranged to deflect the air radially outwardly in the horizontal direction along the bottom side of the table top from a central region of the table top to an outer peripheral edge of the table top. Preferably, the deflector is arranged to deflect the air outwardly in a horizontal 360° pattern around the periphery of the table top. The 360° pattern may be continuous or interrupted. The air may be ambient temperature, heated above ambient temperature, and/or cooled below ambient temperature.

According to one exemplary arrangement according to the teachings of the present disclosure, a table includes a table top, the table top having an outer periphery encompassing a flat top surface disposed in a first plane and adapted to support items set thereon, and a support pedestal extending downwardly from a central region of a bottom side of the table top and operatively supporting the table top. The support pedestal is spaced radially inwardly from the outer peripheral edge of the table top such that a space for a user's knees and/or legs is defined underneath the outer peripheral edge of the table top around surrounding the periphery of the support pedestal. A plenum extends upwardly through a central region of the support pedestal. A fan is disposed under the table top. The fan is arranged to blow an air stream upwardly through the plenum toward the bottom side of the table top. An air deflector is disposed inside the plenum between the fan and the table top. The air deflector has a first end and a second end, a nose section at the first end and disposed in the air stream, and a flared section at the second end. The flared section is arranged to deflect the air stream radially outwardly toward the outer peripheral edge of the table top in a substantially 360° pattern.

According to another exemplary arrangement according to the teachings of the present disclosure, a table includes a table top, a support pedestal, a fan, a bucket, and a bucket holder. The table top has an outer periphery encompassing a flat top surface disposed in a first plane and adapted to support items set thereon. The support pedestal extends downwardly from a central region of a bottom side of the table top and operatively supports the table top. The support pedestal is spaced radially inwardly from the outer periphery of the table top such that a space for a user's knees and/or legs is defined underneath the outer periphery of the table top around surrounding the periphery of the support pedestal. The support pedestal includes a plenum extending upwardly through a central region of the support pedestal. The fan is disposed under the table top. The fan is arranged to blow an air stream upwardly through the plenum toward the bottom side of the table top and radially outwardly under the table top. The bucket holder includes a recess defined in the top surface of the table top, the recess located centrally in the table top, and a bucket arranged to be removably received within the recess.

In further accordance with any one or more of the foregoing exemplary aspects and/or arrangements, a table according to the present disclosure optionally may include any one or more of the following further forms.

In some preferred forms, the air deflector has the form of a flared bell extending between the first and second ends. The nose may include an end wall and a narrow tube shape at the first end with a circular cross section and the flared section flaring radially outwardly around the entire periphery of the circular cross section along a curve toward the second end. The flared section may be attached to the bottom side of the table top.

In some preferred forms, the support pedestal is in the form of a hollow column or cylindrical tube. The support pedestal has an outer peripheral wall extending from a bottom end to a top end. The outer peripheral wall may define an air inlet or opening at the bottom end, an air outlet or opening at the top end. The plenum may be defined by an inner surface of the outer peripheral wall. The plenum may extend substantially vertically from the air inlet to the air outlet. The fan may be disposed in the air pathway, for example, supported by one or more brackets from the inner surface of the outer peripheral wall. The air deflector may be disposed at the air outlet. The nose may be coaxial with the fan and the plenum. The top end of the outer peripheral wall may be spaced from the bottom side of the table top.

In some preferred forms, a first grill is disposed in the gap between the top end of the peripheral wall and the bottom side of the table top. The first grill may extend around an entire periphery of the upper end of the outer peripheral wall. The first grill may be arranged to direct the air radially outwardly from the outer peripheral wall in a 360° pattern.

In some preferred forms, one or more feet extend downwardly from the bottom end of the pedestal. The feet form one or more air intake openings underneath the bottom end of the pedestal. The feet may be spaced apart around the outer peripheral wall.

In some preferred forms, a second grill is disposed across the air inlet. The feet may extend downwardly from an outer periphery of the pedestal. The grill may be disposed radially inwardly from the feet. The grill may be in a second plane parallel with the first plane of the table top.

In some preferred forms, a top side of the air deflector forms a cavity. The bucket holder may extend downwardly into and/or be at least partly defined by the cavity. The bucket may be shaped complementary to the cavity. The bucket may have a top rim, and the recess may be adapted to received the bucket such that the top rim is located at or below the first plane of the table top. A lid may be removably disposed on the top rim of the bucket. The top rim of the bucket and/or the lid may sit flush with the top surface of the table top. The lid may include one or more finger holes. The recess of the bucket holder may be defined at least partially by a rear surface of the air deflector. An opening may be defined through the table top vertically aligned with the recess.

In some preferred forms, the top surface of the table top and/or the entire table top is formed of glass. The table top may be in the form of a flat planar sheet with a circular outer periphery. The deflector may be formed of plastic and/or metal, such as aluminum or steel. The ice bucket may be formed of plastic and/or metal. The pedestal may be formed of metal and/or plastic. The feet may be formed of metal and/or plastic, such as polypropylene.

In some preferred forms, a water misting system is arranged to introduce water mist into the air stream. The water misting system may be disposed near the air outlet. The water misting system may be disposed inside the plenum. The water misting system may include one or more water atomizing nozzles. The water atomizing nozzles may be arranged to inject water mist into the air stream on the exhaust side of the fan. The water atomizing nozzles may be attached to a water supply line, such as a garden hose. The water misting system may include a moisture control mechanism to control the amount of water mist that is induced into the airstream. The moister control mechanism may include a knob arranged to control the flow of water through the atomizing nozzles. The knob may be arranged to adjust and/or shut off the flow of water through the atomizing nozzles. The water misting system is preferably carried by one or more components of the table, such as the support pedestal and/or the table top.

In some preferred forms, an insect repellant or insecticide is introduced into the air stream, for example with an amount of insect repellant or insecticide disposed in the air stream.

In some preferred forms, a heating element is arranged to heat the air stream.

In some preferred forms, a cooling element is arranged to cool the air stream.

In some preferred forms, a layer of insulation, such as foam or dead air space, may be disposed between the bucket holder and the ice bucket.

In some preferred forms, a filter media is carried by one or both of the first and second grills.

In some preferred forms, the table is adapted for indoor and/or outdoor use.

Additional optional aspects and forms are disclosed, which may be arranged in any functionally appropriate manner, either alone or in any functionally viable combination, consistent with the teachings of the disclosure. These and other aspects and advantages will become apparent upon consideration of the following detailed description.

DETAILED DESCRIPTION

Figure 1:
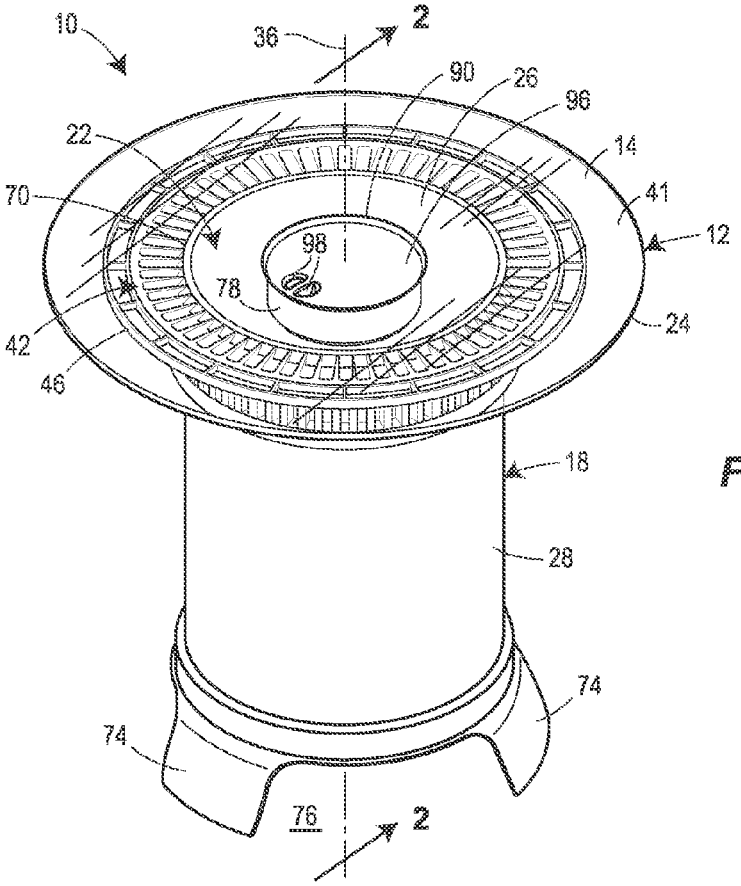
FIG. 1 is a top isometric view of a table exemplary of the teachings of the present disclosure.
Figure 2:
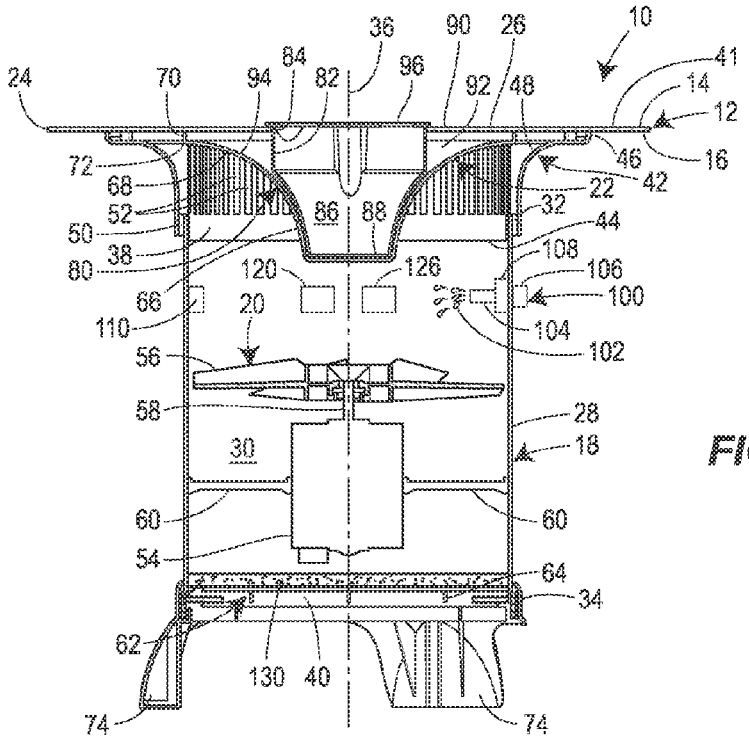
FIG. 2 is a cross-sectional view of the table along the line 2-2 in FIG. 1.
Figure 3:
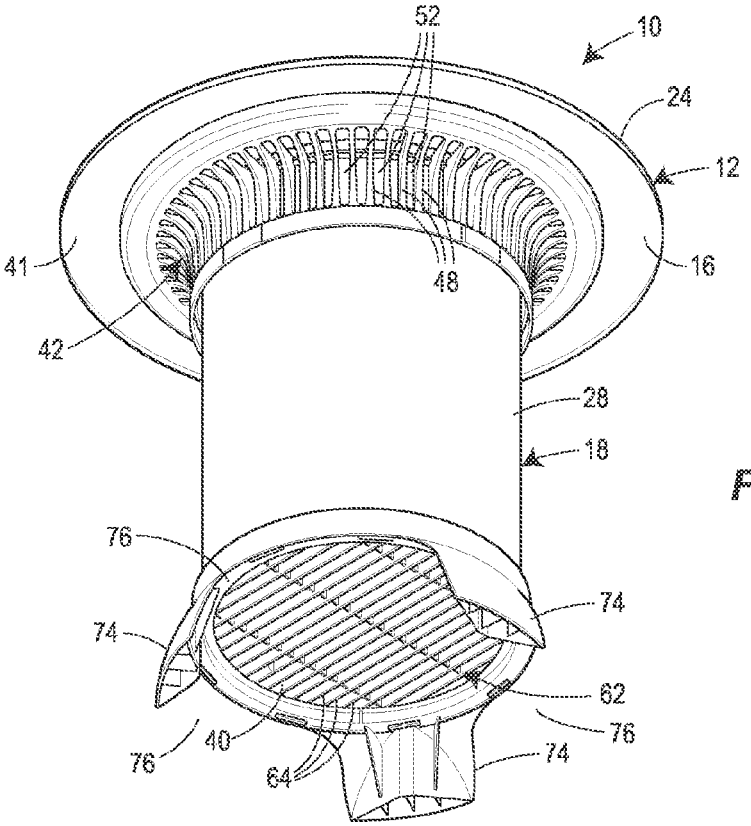
FIG. 3 is a bottom isometric view of the table.
Figure 4:
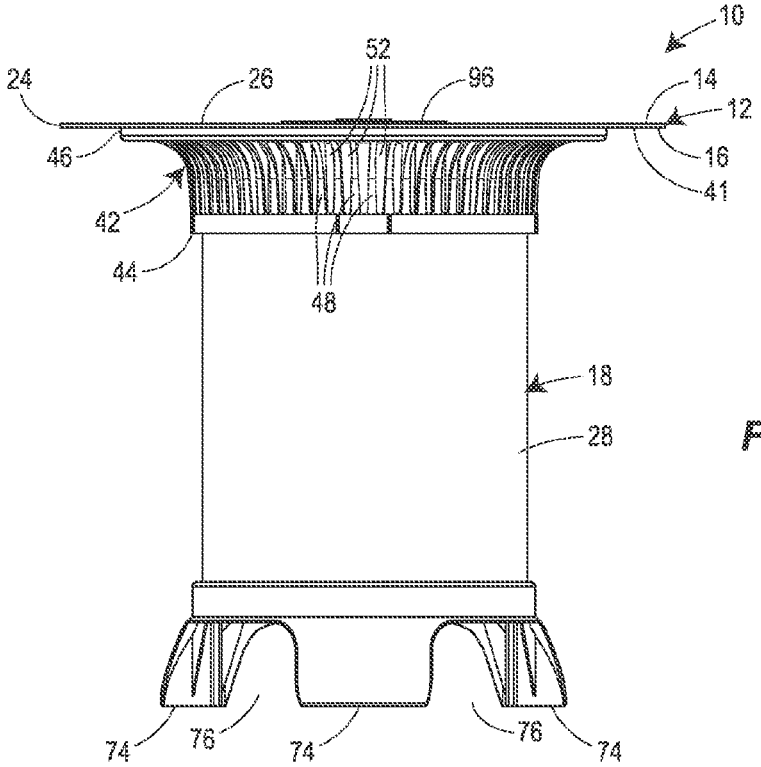
FIG. 4 is a front elevation view of the table, the left side, right side, and rear elevation views being substantially identical to the front elevation view.
Figure 5:
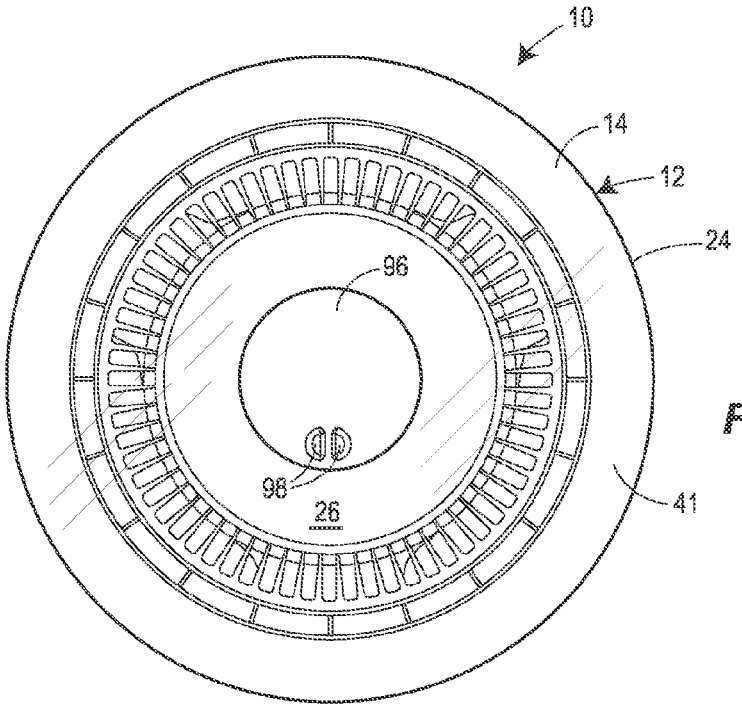
FIG. 5 is a top plan view of the table.
Figure 6:
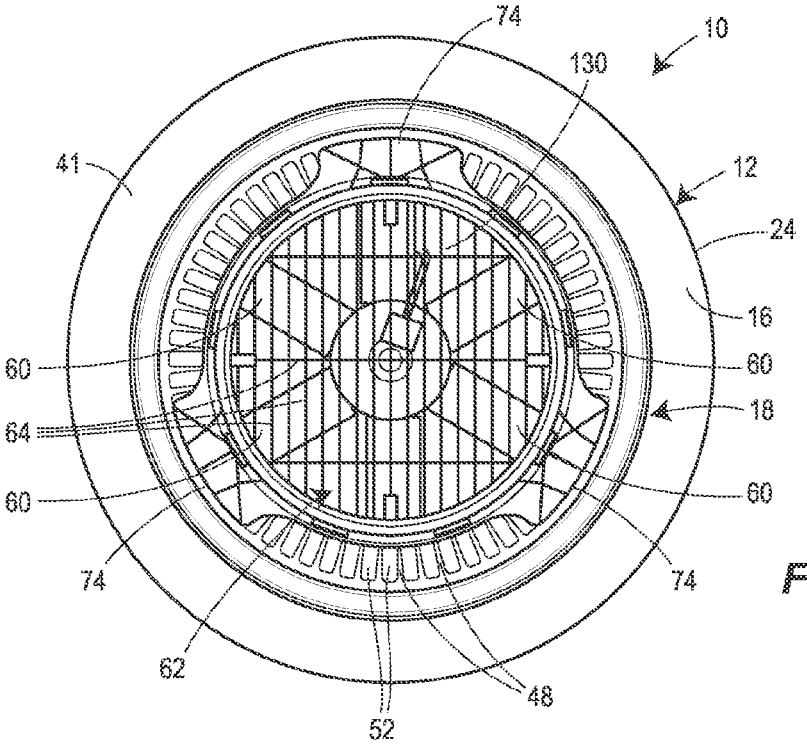
FIG. 6 is a bottom plan view of the table.

Turning now to the figures, a table 10 according to the teachings of the present disclosure includes a table top 12 having a top surface 14 and a bottom side 16, a support pedestal 18 extending downwardly from the bottom side 16 of the table top 12 and arranged to support the table top 12 in a substantially horizontal plane, a fan 20 arranged to blow air upwardly toward the table top 12, and an air deflector 22 arranged to deflect the air from the fan radially outwardly generally horizontally along the bottom side 16 of the table top 12. The table 10 is adapted to condition the air around the table for the comfort of people sitting at or near the table and/or other reasons. For example, the table 10 may be adapted to blow ambient temperature air, cool air that is cooler than ambient temperature, warm air that is warmer than ambient temperature, moistened air, fragrances, insect repellants, insecticides, and/or other airborne materials. The table 10 may be used indoors and/or outdoors.

The table top 12 preferably has an outer peripheral edge 24 encompassing the top surface 14. The outer peripheral edge 24 may be circular, oval, rectangular, or some other shape suitable for a table top; however, other aesthetically pleasing shapes and arrangements are also contemplated. The top surface 14 preferably is substantially flat, such as being planar in the horizontal plane, in order to support myriad items thereon, such as plates, cups, and the like. Preferably, the table top 12 is formed of a sheet of transparent material, such as glass, although other materials, such as metal, wood, stone, and/or plastic, may also or alternatively be used. While still being substantially flat, the top surface 14 may include various surface structures, such as cup holders, holes, recesses, and/or small ridges and the like (not shown) for holding small items or similar function, as long as the top surface 14 is preferably generally in a single plane.

The support pedestal 18 preferably is in the form of a vertically oriented body disposed under a central area 26 of the table top 12 and arranged to support the table top 12 at a comfortable and/or suitable height for use as an indoor and/or outdoor table. Although other support structures, such as legs or braces (not shown), may also be used to support the table top 12 in addition to the support pedestal 18, in the exemplary arrangement of the figures, the table top 12 is supported solely by the one support pedestal 18. The body of the support pedestal 18 is preferably a vertically oriented column or tube, such as a hollow cylindrical tube, defined by an outer peripheral wall 28, such as a cylindrical wall; however, other aesthetically pleasing shapes and arrangements are also contemplated. The body of the support pedestal 18 defines a plenum 30, such as an inner bore defined by the peripheral wall 28. The peripheral wall 28 has an upper end 32, a lower end 34, and a longitudinal axis 36 extending from the upper end 32 to the lower end 34 and oriented substantially vertically. The upper end 32 defines an air exhaust opening 38 out of a top end of the plenum 30. The lower end 34 defines an air intake opening 40 into the bottom end of the plenum 30. Preferably, one or both of the air exhaust opening 38 and the air intake opening 40 is coaxial with the axis 36. The support pedestal 18 supports the table top 12 in a substantially horizontal orientation spaced above a support surface, such as a floor or the ground. The peripheral wall 28 is spaced radially inwardly from the outer peripheral edge 24 of the table top 12, such that an outer peripheral portion of the table top 12 adjacent the outer peripheral edge 24 forms an overhang 41 extending around the outer periphery of the support pedestal 18. Preferably, the table top 12 and the peripheral wall 28 define a space underneath the overhang 41 that is suitable in size for a person place his or her feet, shins, and knees underneath the overhang 41, for example, while sitting at the outer peripheral edge 24 of the table 10 in a chair. For example, the support pedestal 18 preferably maintains the top surface 14 of the table top 12 approximately twenty four to forty eight inches (61-122 cm) above the floor or ground, the table top may be approximately twenty four to sixty inches (61-152 cm) in diameter, and the support pedestal 18 may be approximately twelve to thirty inches (30-76 cm) in diameter, thereby providing, for example, a six to forty eight inch (15-122 cm) overhang surrounding the support pedestal 18. In one preferred arrangement, the table 10 is designed for use as an end table or coffee table, wherein the table top 14 has a diameter of approximately 20 inches (51 cm) and a height of about 20 inches (51 cm) above the floor or other support surface. Of course, these dimensions are only exemplary, and other dimensions are also contemplated sufficient for use as a table in a manner understood in the table arts. The support pedestal 18 may be formed of metal, plastic, glass, ceramic, stone, and/or any other material suitable for supporting the table top 12.

A grill 42 preferably is disposed between the upper end 32 of the peripheral wall 28 and the table top 12. The grill 42 extends around the entire periphery of the upper end 32 of the peripheral wall 28. The grill 42 is arranged to allow air to exhaust from the plenum 30 while preventing larger items, such as debris and/or a person's hands or feet, from entering the plenum 30 through the air exhaust opening 38. The grill 42 has a bottom edge 44, a top edge 46, and a plurality of ribs 48 extending between the bottom edge and the top edge 46. The bottom edge 44 is preferably circular and is connected to and supported by the top end of the peripheral wall 28 generally horizontally. Preferably, the bottom edge 44 defines an annular groove 50. The annular groove 50 receives the top edge of the peripheral wall 28. The top edge 46 is also preferably circular and defines a support surface for the table top 12. Preferably, the top edge 46 is flared outwardly to form a generally horizontally oriented ring; however, other aesthetically pleasing designs are also possible. The ribs 48 are spaced apart circumferentially around the grill 42 and define one or more vents 52 directed radially outwardly from the longitudinal axis 36. The ribs 48 and the vents 52 are preferably oriented generally vertically; however the ribs 48 may be arranged in other aesthetically pleasing arrangements, such as in a slanted alignment, a horizontal alignment, and/or have other non-linear decorative shapes. Preferably, the ribs 48 and the vents 52 are spaced around the entire circumference of the grill 42 to provide a 360° pattern of radial airflow out from underneath the table top 12. In the exemplary arrangement, the ribs 48 are curved to flare outwardly in a bell shape; however, other aesthetically pleasing shapes and arrangements are also contemplated. The table top 12 is operatively disposed on top of the top edge 46 of the grill 42, and may be secured in place, such as with adhesives or fasteners, or may be unsecured.

The fan 20 preferably is disposed in the plenum 30 of the support pedestal 18. The fan 20 may take any form, such as an axial flow fan or a centrifugal flow fan, sufficient to blow air in an airstream upwardly through the plenum 30 and radially out through the vents 52 of the grill 42. In the exemplary arrangement of the figures, the fan 20 is an axial flow fan, and includes an electric motor 54 operatively connected to a set of one or more fan blades 56, for example by a drive shaft 58. The fan 20 may be supported by any convenient structure, such as by one or more brackets 60 operatively connecting the motor 56 to the inner diametrical surface of the peripheral wall 28. Preferably, the fan 20 is disposed inside the plenum 30 at a location between the upper end 32 and the lower end 34 of the peripheral wall 28. Appropriate electrical power connections and controls (not shown) for powering and controlling the fan 20 are provided in any suitable manner understood in the art.

A second grill 62 preferably is disposed across the air intake opening 38. The grill 62 is arranged to allow air to enter the plenum 30 while preventing larger items, such as debris and/or a person's hands or feet, from entering the plenum 30 through the air inlet opening 40. The grill 62 is preferably formed of a set of spaced apart ribs or bars 64 disposed approximately in a planar arrangement; however, other aesthetically pleasing shapes and arrangements may be used. Preferably, the grill 62 is oriented in a second plane that is parallel with the plane of the table top 12.

The air deflector 22 preferably is disposed inside the plenum 30 between the fan 20 and the table top 12. A nose section 66 is formed at a first end of the air deflector 22. A flared section 68, such as a bell-shaped flare, is formed at a second end of the air deflector 22 opposite the nose section 66. The nose section 66 is disposed in the air stream blowing vertically upwardly from the fan 20, and the flared section 68 is arranged to deflect the air stream horizontally and radially outwardly through the vents 52 toward the outer peripheral edge of the table top in a substantially 360° pattern. The 360° pattern may be continuous or discontinuous. Preferably, the air deflector 22 has the shape of a bell, having an arcuate flared cross section extending between the first and second ends and revolved about a central axis, such as the longitudinal axis 36, the nose section 66 having a narrow tube shape with a circular cross section, and the flared section 68 flaring radially outwardly from the nose section 66 around the entire periphery of the circular cross section along a curve. The second end of the air deflector 22 is preferably aligned horizontally with the top edge 46 of the grill 62, such that the table top 12 is disposed against or immediately adjacent to the second end of the air deflector 22. The air deflector 22 is oriented with the nose section 66 pointed downwardly toward the fan 20 and the flared section 66 pointing upwardly toward the table top 12. Preferably, the air deflector 22, and optionally the fan 20, is/are coaxially aligned with the peripheral wall 28 along the longitudinal axis 36. The air deflector 22 may be supported by the grill 62, for example with an outer peripheral edge 70 of the flared section 68 resting on an inner annular shoulder 72 defined by the grill 62 just below the top edge 46. The air deflector 22 is preferably formed of a hard plastic; however, other materials suitable for one or more functions considered herein, such as aluminum or steel, may also or alternatively be used.

A plurality of spaced apart feet 74 preferably project downwardly below the support pedestal 18. Preferably, the feet 74 are disposed around the lower end 34 of the support outer peripheral wall 28. The feet 74 are arranged to rest on the ground or floor and support the support pedestal 18 spaced above the ground or floor. A window 76 is defined between each adjacent pair of feet 74 around the peripheral wall 28. The windows 76 provide air flow paths, such as air intakes, by which air may flow from the surrounding atmosphere, through the windows, to the grill 62 and air intake opening 40, and from there up through the plenum 30. The feet 74 may have any decorative design or any number and spacing therebetween sufficient to allow air to flow through the windows 76 into the air intake opening 40. The feet 74 may be formed of the same or different materials as the support pedestal 18.

A bucket 78, such as an ice bucket, may be removably carried within a bucket holder 80. The bucket 78 preferably has a circular cross-section, including a side wall 82 extending from a top rim 84 to a bottom end, and a bottom wall 88 extending across the bottom end. The top rim 84 defines an opening into a chamber 86, such as for holding ice or other items. The bucket holder 80 is formed of a recess in the table top 12, wherein the recess is sized and adapted to receive the bucket 78. The bucket holder 80 is preferably disposed in the central region 26 of the table top 12. Preferably, the bucket holder 80 is formed by a hole 90 through the table top 12 that opens into a cavity 92 defined in a rear side of the air deflector 22. The hole 90 is complementary to the cross section of the bucket 78, for example by being circular for a circular bucket. The cavity 92 is preferably defined by the rear surface 94 of the nose section 66 and the flared section 68. Preferably, the bottom wall 88 of the bucket 78 is sized complementary to the end of the nose section 66. The sidewall 86 of the bucket 78 optionally has an arcuate bottom section that is complementary to the rear side of the air deflector 22. The bucket 78 fits down through the hole 90. The top rim 84 may include an annular lip that sits on the edge of the table top 12 surrounding the hole 90. The bottom wall 88 and the sidewall 86 of the bucket 78 preferably sit on the rear surfaces 94 of the nose section 66 and the flared section 68, respectively. Preferably, the bucket 78 sits in the bucket holder 80 with the top rim 84 substantially flush with the top surface 14 of the table top 12, such as resting on top of or slightly recessed below the top surface 14. The bucket 78 may sit unsecured in the bucket holder 80, whereby a user may easily remove and/or replace the bucket from within the bucket holder 80. Optionally, a lid 96 removably covers the opening into the holding chamber 86. The lid 96 optionally includes one or more finger holes 98 sized and arranged to provide an easy grasping mechanism for a user to remove and/or replace the lid 96 over the opening. The lid 96 is preferably arranged to be flush with the top surface 14 of the table top 12 when the bucket 78 is operatively disposed in the bucket holder 80. The bucket 78 may be formed of metal, plastic, ceramic, glass, or any other materials suitable for holding ice or other materials.

A water misting system 100 optionally may be arranged to introduce water mist 102 into the air stream from the fan 20. The water misting system 100 may be adapted to provide cool and/or moist air through the vents 52, and from thence to a person sitting at or near the table 10. The water misting system 100 may be disposed inside the plenum 30 and arranged to provide a water mist into the air stream from the fan 20 near the air exhaust opening 38 between the fan 20 and the grill 42. Water mist 102 sprayed or otherwise from the water misting system 100 may optionally be chilled below ambient temperature. Preferably, the water misting system 100 includes or more water atomizing nozzles 104. The water atomizing nozzles 104 are arranged to inject water mist into the air stream on the exhaust side of the fan. For example, each water atomizing nozzle 104 may be disposed on the inner surface of the peripheral wall 28 above the fan 20 and below the grill 42. The water atomizing nozzles 104 are operatively connected to a water supply line (not shown). The water supply line may be permanently connected to the water atomizing nozzles 104, such as by a permanently connected water line, or may be removably attached to the water atomizing nozzles 104, such as with a threaded connection to a garden hose. The water misting system 100 may include a moisture control mechanism to control the amount of water mist that is induced into the airstream. In one preferred arrangement, a knob 106 is arranged to control the flow of water through the atomizing nozzles 104. The knob 106 preferably adjusts a flow control valve 108 arranged to adjust and/or shut off the flow of water from the water supply line through one or more of the atomizing nozzles 106. Preferably, the water misting system 100 is carried by and/or secured to one or more components of the table 10, such as the support pedestal 18 and/or the table top 12, so as to move and be stored as an integral part of the table 10.

A volatile active delivery system 110 optionally may be provided including a delivery apparatus arranged introduce an insect repellant or insecticide into the air stream, for example with an amount of insect repellant or insecticide disposed in the air stream. The volatile active delivery system 110 may include a passive volatile active delivery apparatus, such as a solid block or gel package of active volatile ingredients that volatilizes into the air stream from the fan 20. The delivery system 110 may include an active volatile active delivery apparatus, such as a thermally assisted delivery system including a heating element and/or an electromechanically assisted delivery system including a piezoelectric vibrator or fan. In one arrangement, the volatile active deliver system 110 may be operatively mounted on an intake side of the fan 20. For example, the volatile active deliver apparatus may be disposed near the air intake opening 38, such as with a solid block or gel package of insect repellant or insecticide operatively connected to the grill 62. The delivery system 110 may include other types of volatile active delivery apparatuses as would be understood in the art.

A heating element 120 optionally may be arranged to heat the air stream from the fan 20. The heating element 120 may include one or more resistive electric heating coils or elements. Preferably the heating element 120 is disposed inside the plenum 30, above the fan 20 and below the table top 12.

A cooling element 126 optionally may be arranged to cool the air stream from the fan 20. The cooling element 126 may include one or more cooling coils or elements. Preferably the cooling element 126 is disposed inside the plenum 30, above the fan 20 and below the table top 12.

A layer of insulation (not shown), such as foam or dead air space, optionally may be disposed between the read surface of the air deflector 22 and the bucket 78 so as to thermally isolate the bucket from heat and/or cool air being blown against the air deflector 22 from the fan 20.

One or more filter media 130 optionally may be disposed across the plenum 30, such as near either or both of the air intake opening 40 and the air exhaust opening 38. The filter media 130 may be, for example, carried by one or both of the first and second grills 42, 62. Preferably, the filter media 130 is disposed the intake side, i.e., the exterior side, of the grill 62. In this arrangement, the grill 62 may provide a structural support for the filter medial 130, and also may prevent the filter media 130 from being sucked into the fan 20.

The table 10 disclosed herein may be useful for providing a more pleasant experience for a person sitting at the table by, for example, blowing warm, cool, and/or moist air and/or insect repellent or insecticide across the legs and/or torso of the person while sitting at the table. The table 10 may be particularly useful in outdoor environments where there is no air conditioning and/or insects may be particularly irksome.

Numerous functional and aesthetic modifications to the table and components thereof disclosed herein will be apparent to those skilled in the art in view of the foregoing description. Accordingly, this description is to be construed as illustrative only and is presented for the purpose of enabling those skilled in the art to make and use the table and to teach the best mode of carrying out same. The exclusive rights to all modifications which come within the scope of the appended claims are reserved.

We claim:

1. A table comprising:

a table top;

a support pedestal extending downwardly from a bottom side of the table top, the support pedestal arranged to support the table top aligned generally horizontally and spaced above the floor or ground, wherein the table top has an outer periphery, a plenum included in the support pedestal;

a fan arranged to blow an air stream upwardly toward the table top through the plenum;

an air deflector arranged to deflect the air stream radially outwardly in the horizontal direction along the bottom side of the table top from a central region of the table top to an outer peripheral edge of the table top, wherein the air deflector includes a first end and a second end, a nose section at the first end and disposed in the air stream, and a flared section at the second end, wherein the flared section is arranged to deflect the air stream radially outwardly toward the outer peripheral edge of the table top;

a bucket; and a bucket holder comprising a recess into or through the top surface of the table top, the bucket holder located centrally in the table top, and the bucket arranged to be removably received within the recess, the bucket having a top rim, the recess adapted to receive the bucket such that the top rim is located flush with or below a first plane of the table top, wherein a top side of the air deflector forms a cavity, and the bucket holder is at least partly defined by the cavity.

2. A table according to any of the previous claims, wherein the outer periphery encompasses a flat top surface disposed in the first plane and adapted to support items set thereon, and, optionally, wherein the support pedestal is spaced radially inwardly from the outer peripheral edge of the table top such that a space for a user's knees and/or legs is defined underneath the outer peripheral edge of the table top around surrounding the periphery of the support pedestal.

3. A table according to claim 1, wherein the bucket is shaped complementary to the cavity.

4. A table according to claim 1, further comprising a layer of insulation disposed between the bucket holder and the bucket.

5. A table according to claim 1, further comprising a water misting element arranged to spray a mist of water into the air stream.

6. A table according to claim 1, further comprising a volatile active delivery system for delivering at least one of an insect repellant and insecticide into the air stream, wherein the volatile active delivery system comprises at least one of a passive volatile active delivery apparatus and an active volatile active delivery apparatus.

7. A table according to claim 1, wherein the air deflector is arranged to deflect the air outwardly in a horizontal 360° pattern around the periphery of the table top, and wherein the 360° pattern is either continuous or interrupted.

8. A table according to any of the previous claims claim 1, wherein the flared section is attached to the bottom side of the table top.

9. A table according to claim 8, wherein the air deflector has the form of a flared bell extending between the first and second ends, the flared section flaring radially outwardly around the entire periphery of the circular cross section along a curve toward the second end.

10. A table according to claim 1, wherein the air deflector is disposed at the air outlet, and the nose of the air deflector is coaxial with the fan and the plenum.

11. A table according to claim 1, further comprising at least one of a heating element arranged to heat the air stream above ambient temperature, and a cooling element arranged to cool the air stream below ambient temperature.

12. A table according to claim 1, wherein the plenum extends upwardly through a central region of the support pedestal.

13. A table according to claim 1, wherein the support pedestal is in the form of a hollow column or hollow cylindrical tube.

14. A table according to claim 1, wherein the support pedestal has an outer peripheral wall extending from a bottom end to a top end, wherein the outer peripheral wall defines an air inlet opening at the bottom end and an air exhaust opening at the top end, and the plenum is defined by an inner surface of the outer peripheral wall.

15. A table according to claim 14, wherein the fan is disposed in the plenum and supported by one or more brackets from the inner surface of the outer peripheral wall.

16. A table according to claim 14, wherein a first grill is disposed in a gap between the top end of the peripheral wall and a bottom side of the table top, the gap defining at least one vent through which the air stream exits radially outwardly.

17. A table according to claim 16, wherein one or more feet extend downwardly from the bottom end of the support pedestal, and wherein a second grill is disposed across the air inlet opening, and the second grill is disposed radially inwardly from the feet.

18. A table according to claim 17, further comprising a filter media disposed at least at one of the air inlet opening and the air exhaust opening, wherein the filter media is carried by one or both of the first and second grills.

19. A table according to claim 14, wherein one or more feet extend downwardly from the bottom end of the support pedestal, and wherein the feet form one or more air intake openings underneath the bottom end of the pedestal.

* * * * *

UNITED STATES PATENT AND TRADEMARK OFFICE

CERTIFICATE OF CORRECTION

PATENT NO. : 9,084,477 B2
APPLICATION NO. : 14/049853
DATED : July 21, 2015
INVENTOR(S) : Kurt Westbrook et al.

It is certified that error appears in the above-identified patent and that said Letters Patent is hereby corrected as shown below:

On the Title Page:

At Column 2, under "Primary Examiner", line 1, "Robin Rohrhoff" should be -- Daniel Rohrhoff --.

In the Claims:

At Column 9, line 17, "any of the previous claims," should be -- claim 1, --.

At Column 9, line 43, "any of the previous claims claim 1," should be -- claim 1, --.

Signed and Sealed this
First Day of March, 2016

Michelle K. Lee

Michelle K. Lee
*Director of the United States Patent and Trademark Office*